US006463650B1

(12) United States Patent
Bougamont et al.

(10) Patent No.: US 6,463,650 B1
(45) Date of Patent: Oct. 15, 2002

(54) DEVICE AND METHOD FOR ASSEMBLING A PUMP ON A CONTAINER

(75) Inventors: Jean-Louis Bougamont, Eu; Hervé Lompech, Incheville; Pierre Dumont, Eu, all of (FR)

(73) Assignee: Rexam Sofab, Le Treport (FR)

( * ) Notice: Subject to any disclaimer, the term of this patent is extended or adjusted under 35 U.S.C. 154(b) by 0 days.

(21) Appl. No.: 09/509,563

(22) PCT Filed: Oct. 16, 1998

(86) PCT No.: PCT/FR98/02226

§ 371 (c)(1),
(2), (4) Date: Apr. 17, 2000

(87) PCT Pub. No.: WO99/20401

PCT Pub. Date: Apr. 29, 1999

(30) Foreign Application Priority Data

Oct. 16, 1997 (FR) ..... 97 12962

(51) Int. Cl.[7] ..... B21D 11/02; B65D 45/30; B65D 88/54; B65D 83/00

(52) U.S. Cl. ..... 29/453; 215/274; 222/321.7; 222/402.13; 29/450

(58) Field of Search ..... 29/509, 508, 506, 29/510, 453, 450; 215/274, 273, 276, 277, 279, 317, 321, 275; 222/321.7, 321.8, 321.9, 322, 400.8, 401, 402, 402.13

(56) References Cited

U.S. PATENT DOCUMENTS 3,301,425 A * 1/1967 Brandtberg
5,299,703 A 4/1994 Cater

FOREIGN PATENT DOCUMENTS

EP 0707895 4/1996

* cited by examiner

*Primary Examiner*—S. Thomas Hughes
*Assistant Examiner*—John C. Hong
(74) *Attorney, Agent, or Firm*—Bacon & Thomas, PLLC

(57) ABSTRACT

The invention relates to a device for assembling and packaging a pump (P) and a receptacle (R) of the type comprising firstly a fixing bush (1) provided on its inside wall with elastically deformable elements (11) for fastening beneath a collar (C) of the neck of the receptacle (R), and secondly with a packaging skirt (2) that is malleable, at least in part, clamped radially against the outside wall of said bush (1), the device being characterized in that said bush (1) has setbacks (10) formed in its outside wall in register with the fastener elements (11), defining an intermediate empty zone in which said skirt (2) is not liable to be deformed by said elements (11).

9 Claims, 6 Drawing Sheets

DEVICE AND METHOD FOR ASSEMBLING A PUMP ON A CONTAINER

BACKGROUND OF THE INVENTION

1. Field of the Invention

The present invention relates to a device for and a method of assembling and packaging a pump and a receptacle.

2. Related Art

In some cases, pumps can be assembled on receptacles or flasks, for example by means of a fixing bush provided on its inside wall with elastically deformable elements for fastening beneath a collar secured to the neck of the receptacle, and packaging is performed by means of a skirt designed at least in part to clamp radially against the outer wall of said bush.

By way of example, the packaging skirt is made out of a malleable material making it possible to obtain clamping that fits and is durable, but that is not elastically deformable.

Thus, a subsequent force or shock on said skirt can give rise to remanent deformation which is unsightly.

Unfortunately, mounting the bush on the neck of the receptacle necessarily implies temporarily flaring at least some of the bottom portion of the bush as it passes over the projecting collar. If the skirt is already clamped in position on the bush, the fastener elements move apart, thereby applying force to the skirt with the direct consequence of deforming it.

One solution consists in putting the skirt into place later on. The fastener elements can then move freely, but it becomes necessary to perform a subsequent and additional operation in order to mount the skirt on the bush.

A variant consists in initially engaging the skirt on the top portion only of the bush, prior to locking it on the receptacle by elastically deforming the fastener elements, and then in lowering the skirt fully while radially clamped on the bush.

However, all of the solutions implemented in the past lead to an increase in the cost of the assembly method and, in addition, they are not satisfactory technically speaking or in terms of appearance.

In all cases, locking the bush leaves a small amount of remanent deformation in its bottom portion, thereby making it difficult to fit the outer skirt subsequently.

In particular, lowering of the skirt is braked or even stopped by resistance from the bottom portion of the bush.

Under such conditions, final assembly can be obtained only after careful adjustment and by exerting axial thrust on the skirt, which runs the risk of giving rise to harmful deformation of said skirt and/or to shavings of material being removed from the wall of the bush.

SUMMARY OF THE INVENTION

An object of the present invention is to resolve those technical problems in satisfactory manner by providing an empty zone in association with the fastener elements and in which the bush is not liable to come into deforming contact with the skirt.

According to the invention, this object is achieved by means of a device for assembling and packaging a pump and a receptacle of the type comprising firstly a fixing bush provided on its inside wall with elastically deformable elements for fastening beneath a collar of the neck of the receptacle, and secondly with a packaging skirt that is malleable, at least in part, clamped radially against the outside wall of said bush, the device being characterized in that said bush has setbacks formed in its outside wall in register with the fastener elements, defining an intermediate empty zone in which said skirt is not liable to be deformed by said elements.

In a particular embodiment, said setback corresponds to the wall of the bush being offset radially inwards.

In an advantageous variant, said setback corresponds to a reduction in the thickness of the wall of the bush.

In a variant, said fastener elements are constituted by catches carried by the inside wall of the bush and designed to snap-fasten beneath the collar of the neck of the receptacle.

In a variant, said catches are topped by respective abutment and wedging faces of profile that matches the collar of the neck.

According to yet another characteristic, said setback is formed over a height that is not less than the height of the neck of the receptacle.

According to other characteristics, said bush carries elements for supporting the pump and elements for sealing the assembly.

The invention also provides a method of assembling and packaging a pump and a receptacle whose neck is provided with a retaining collar, the method being is characterized in that setbacks are formed in the outside wall of an internal fixing bush in register with elastically deformable elements for fastening beneath the collar of the receptacle, a malleable outer skirt is engaged on the internal bush so that at least part of said skirt clamps radially against the outside wall of said bush, and then said fastener elements are deformed by force and locked beneath the collar without altering the outside appearance of said skirt by applying axial thrust to the bush together with the skirt against the neck of the receptacle.

The device of the invention makes it possible to perform assembly in a single operation since the outer skirt and the inner bush can remain united and radially clamped to each other at least in part, while they are being locked on the collar of the receptacle, without the locking giving rise to any kind of deformation of the skirt, and a fortiori to any change in its external appearance.

BRIEF DESCRIPTION OF THE DRAWINGS

In addition, the bush performs functions that are essentially technical functions concerned with supporting and locking the pump and possibly also with sealing the assembly, while the skirt which forms an outer envelope performs a function that is associated essentially with appearance for packaging the bush.

Separating functions in this way makes it possible to optimize the characteristics specific to each component (bush or skirt) in order to obtain the best result (technical or appearance).

Where appropriate, the bush could even be directly integrated in the pump.

Figure 1C:
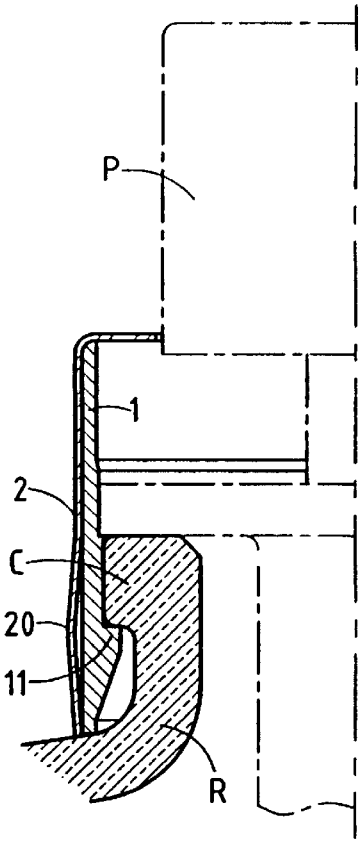
Figure 1B:
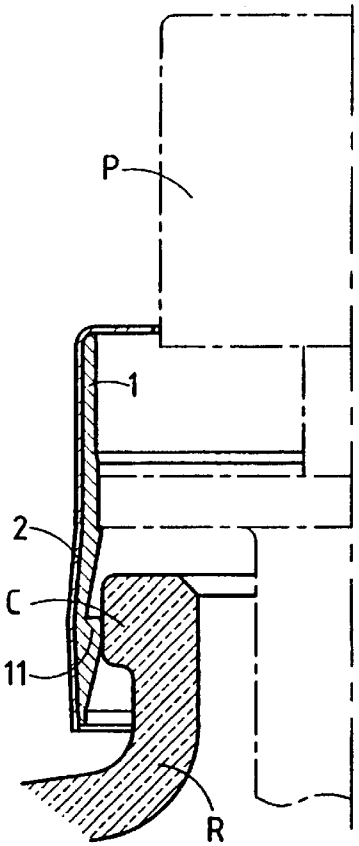
Figure 1A:
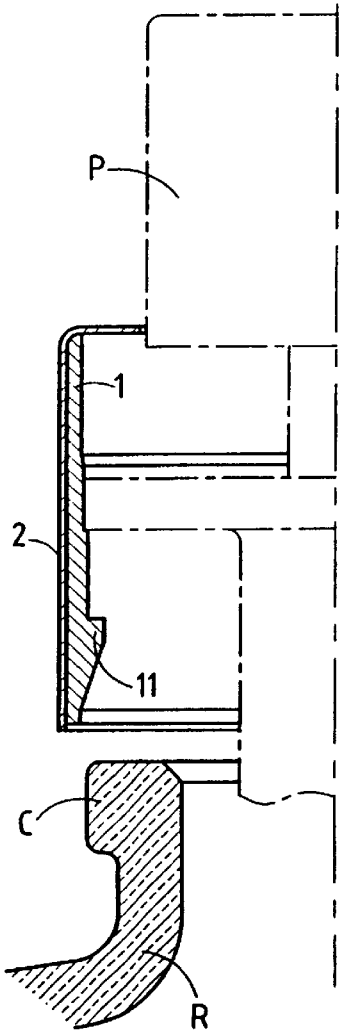
Figure 2C:
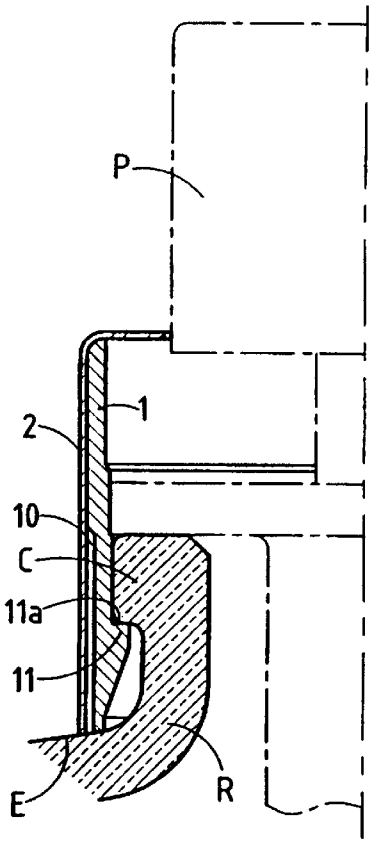
Figure 2B:
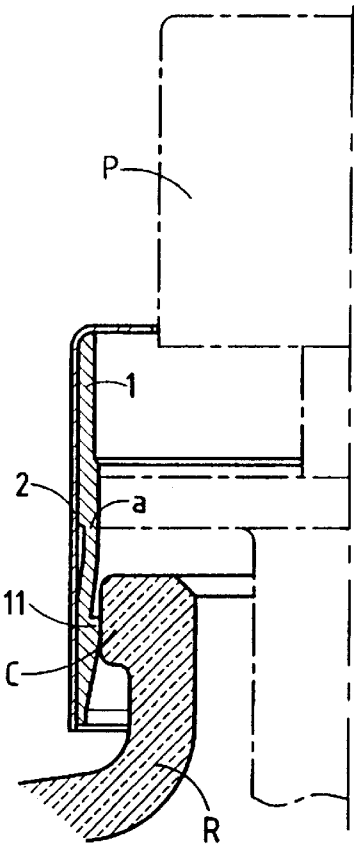
Figure 2A:
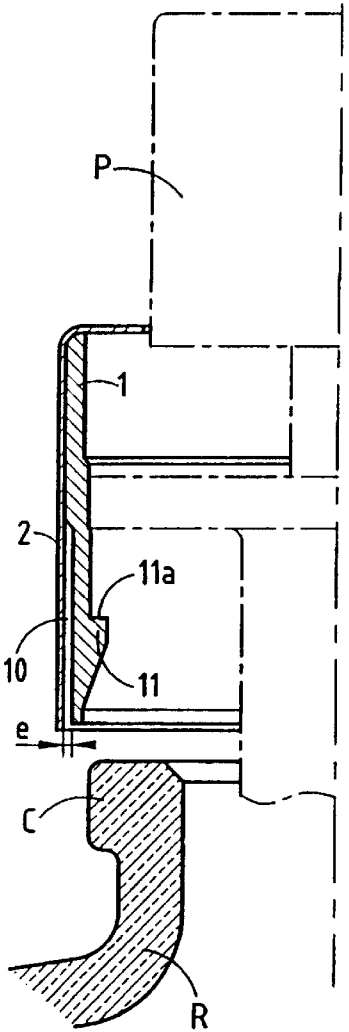
Figure 3A:
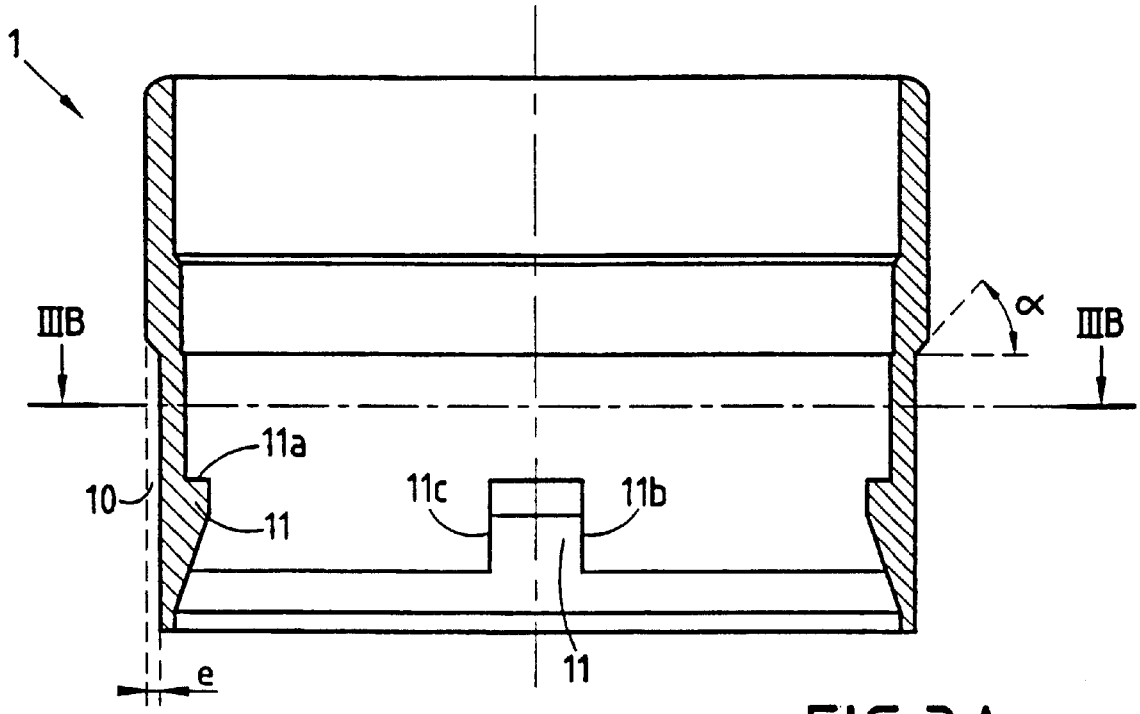
Figure 3B:
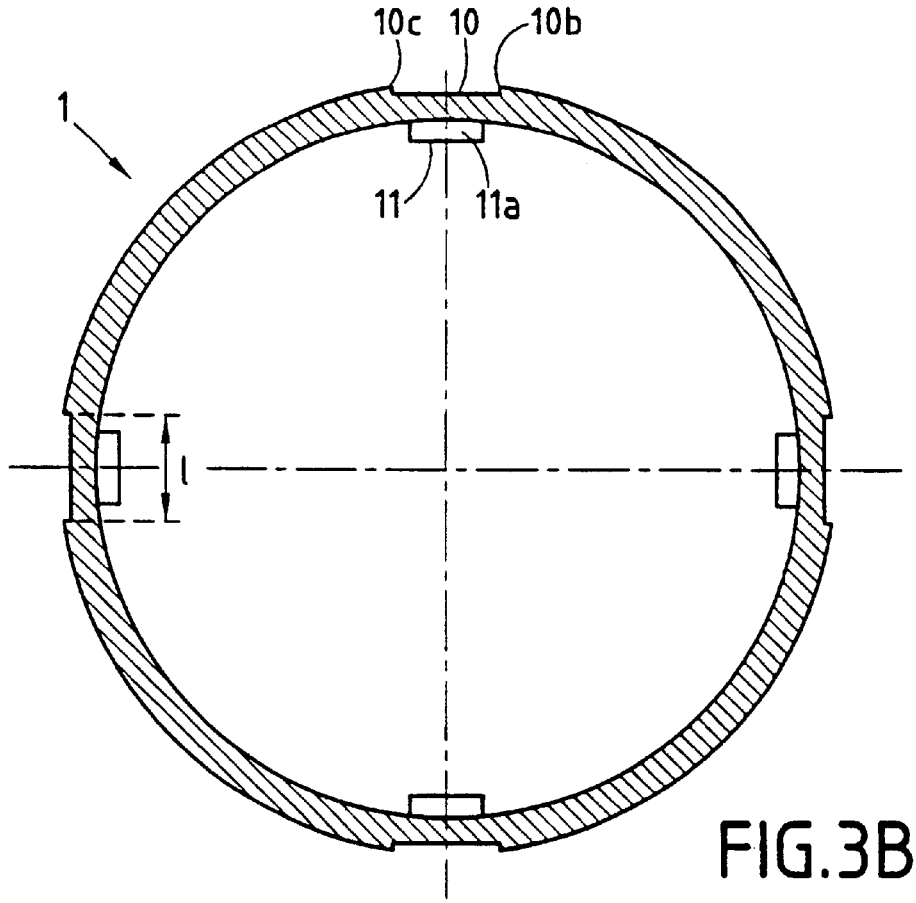
Figure 4A:
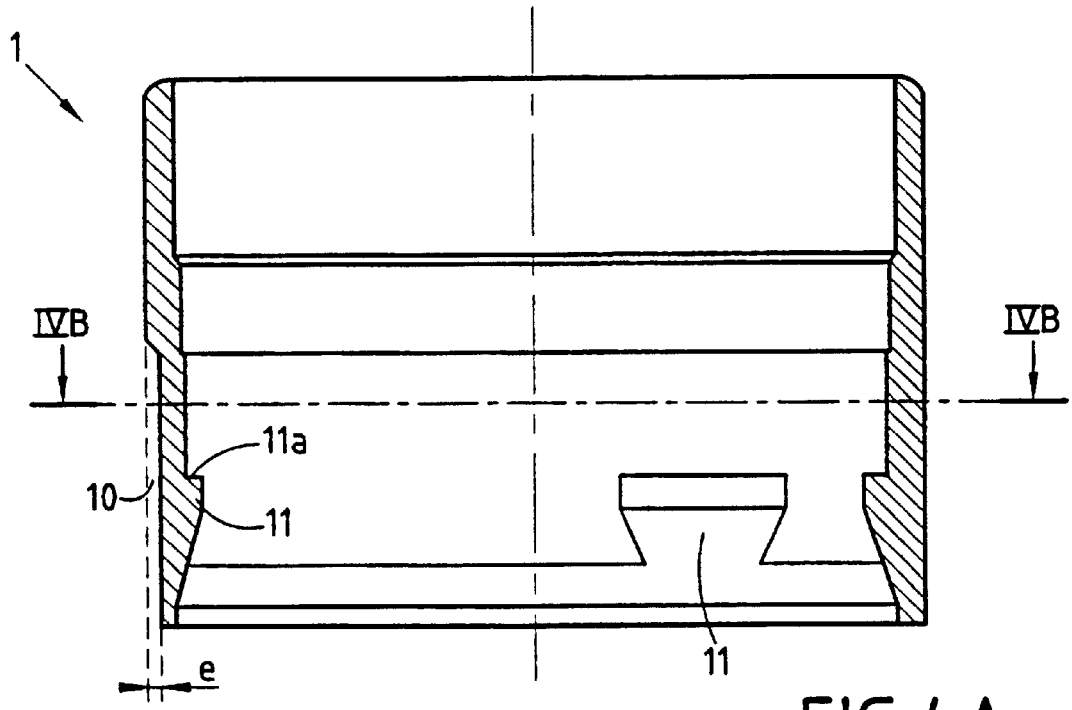
Figure 4B:
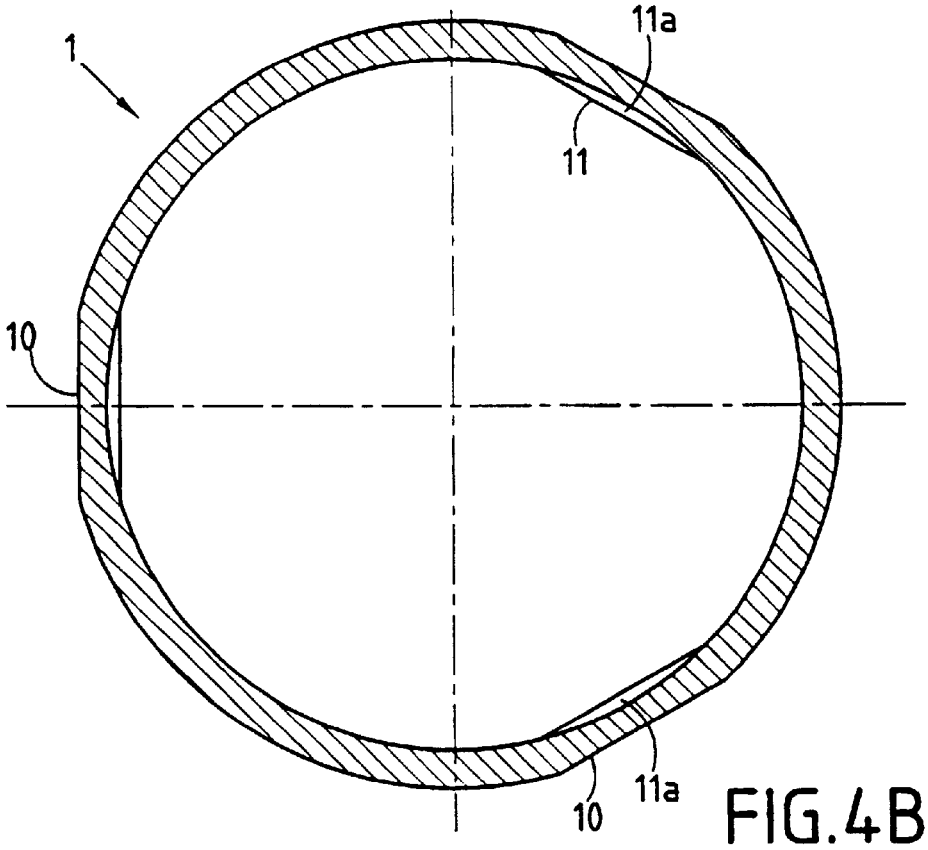
Figure 5A:
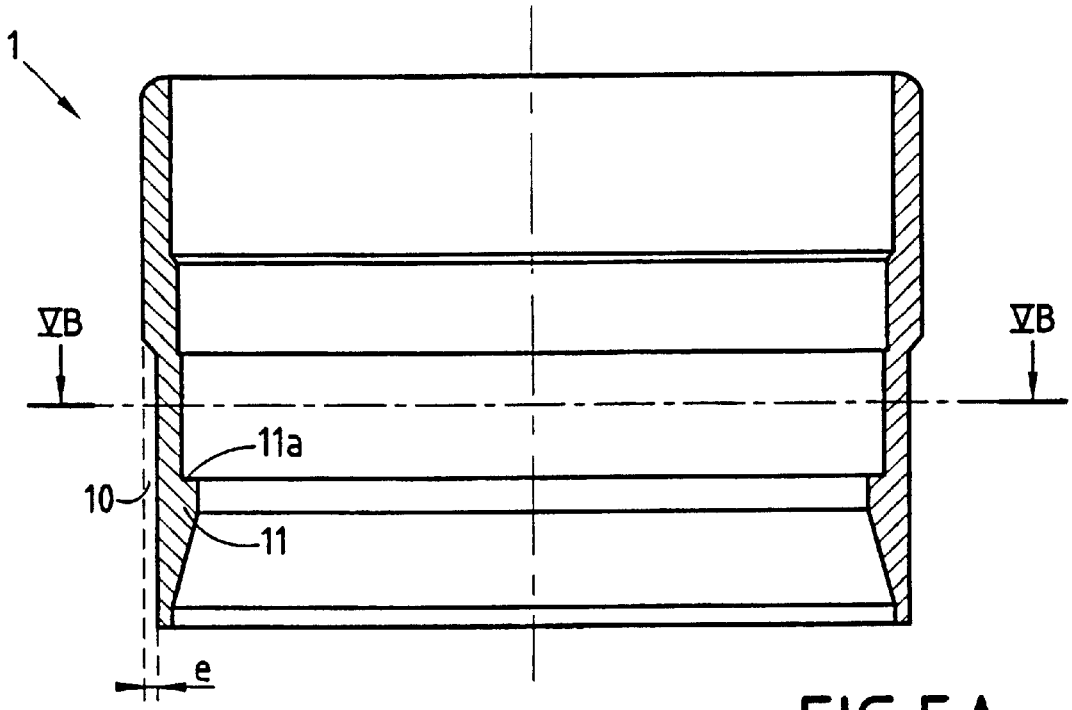
Figure 5B:
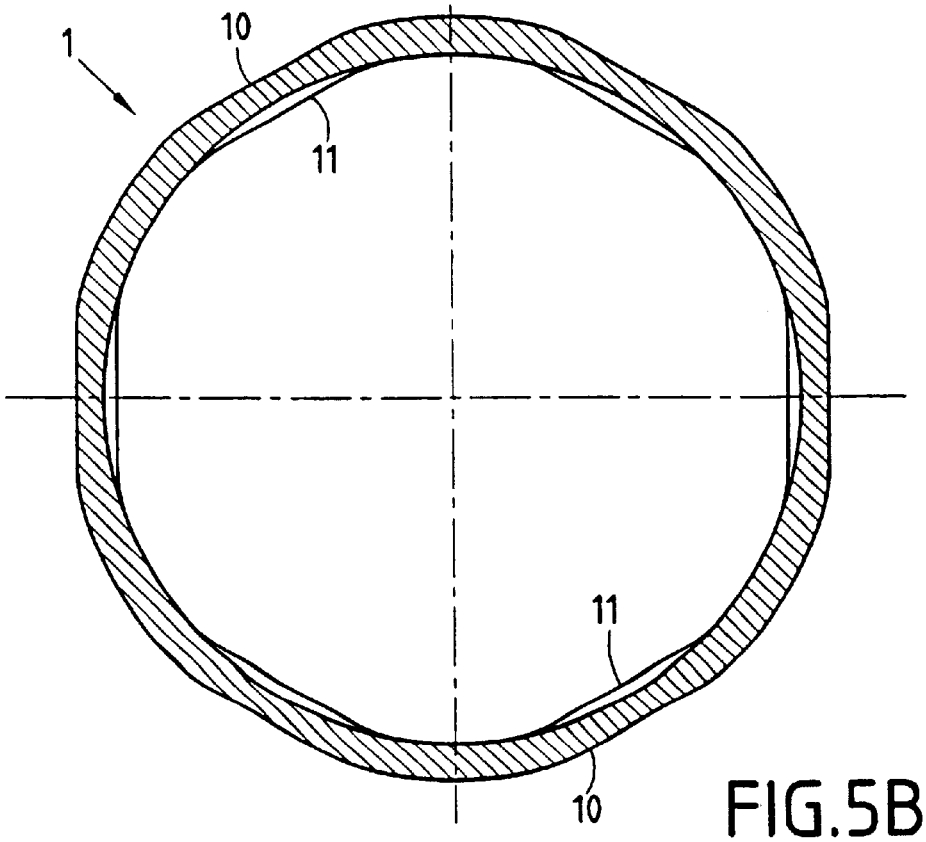
Figure 6:
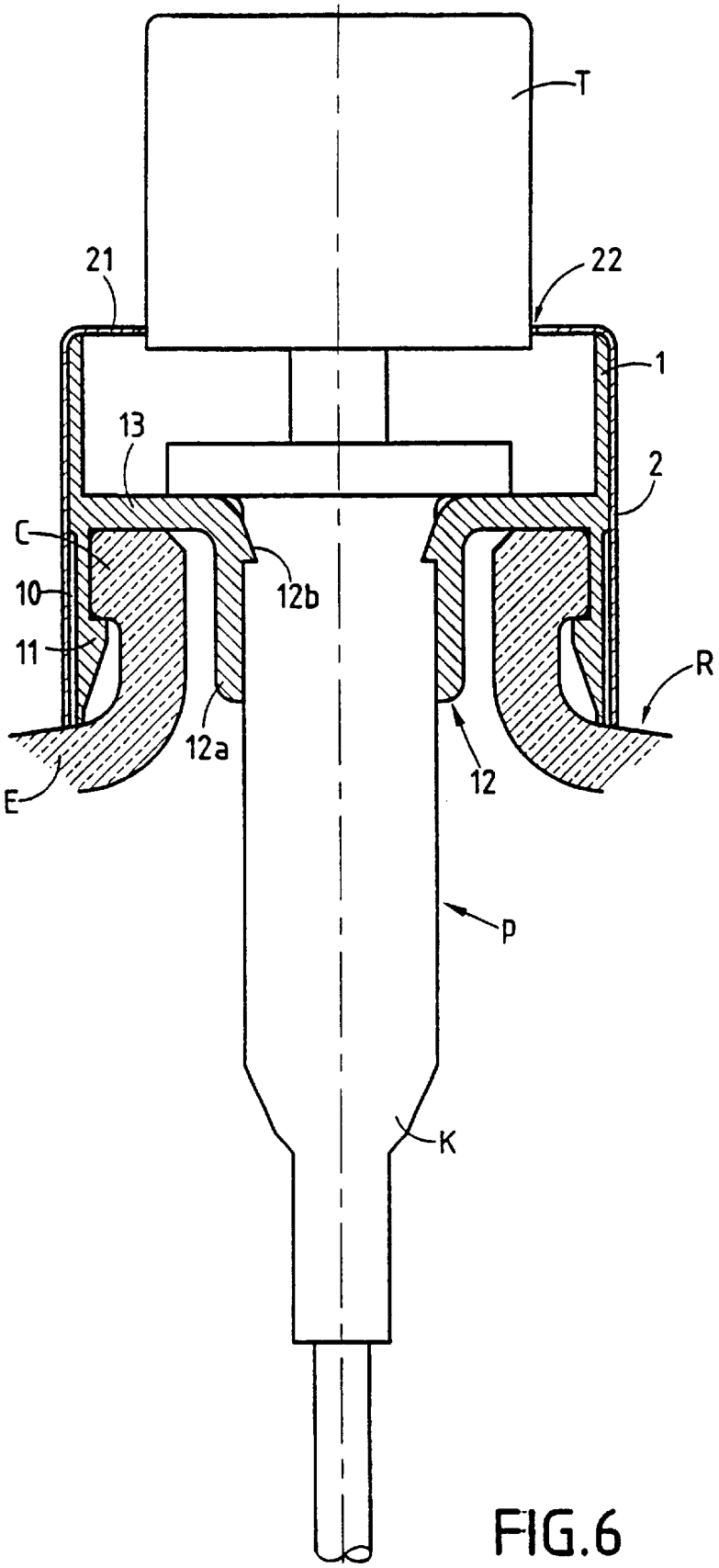

The invention will be better understood on reading the following description, which is accompanied by drawings in which:

FIGS. 1A, 1B, and 1C are fragmentary section views of the prior art during assembly on a receptacle;

FIGS. 2A, 2B, and 2C are fragmentary section views showing the principle of the invention;

FIGS. 3A and 3B are views respectively in vertical section and in horizontal section through a first embodiment of a bush of the invention;

FIGS. 4A and 4B are views respectively in vertical section and in horizontal section through a second embodiment of a bush of the invention;

FIGS. 5A and 5B are views respectively in vertical section and in horizontal section through a third embodiment of a bush of the invention; and FIG. 6 is a vertical section view of a variant embodiment of the bush of the invention.

BRIEF DESCRIPTION OF THE INVENTION

The device shown in FIGS. 1A to 1C corresponds to the prior art and is for assembling a pump P on a receptacle R whose neck is provided with a retaining collar C.

The device comprises a fixing bush 1 provided on its inside wall with elastically deformable elements 11 that serve to lock onto the receptacle R by snap-fastening or hooking under the collar C.

In addition, the device has a packaging skirt 2 placed over the bush 1.

The skirt 2 is made of a malleable material (preferably a metal such as aluminum) and it is designed to be clamped radially against the outside wall of the bush 1 so as to give the appearance of a covering.

To this end, the skirt 2 covers all of the visible outside surfaces of the bush 1 and it has a wall of thickness that is smaller than that of the bush 1.

In FIG. 1B it can be seen that passage over the collar C forces the fastener elements 11 outwards, thereby locally deforming the skirt 2.

In FIG. 1C, the bottom portion of the bush 1 has returned to its initial shape and the fastener element 11 is now in a locking position where it has snapped under the collar C. However, the skirt 2 has retained the deformation it acquired previously because the skirt 2 is malleable so that any deformation of the skirt is remanent, which gives rise to a bulge 20 that spoils the appearance of the device.

FIG. 2A is a diagram that is partially in section showing the device of the invention in a preliminary stage of the assembly and packaging method. In this stage, the skirt 2 covers the bush 1 and is radially clamped on all of its outside surfaces except in its bottom portion situated in the vicinity of the fastener element 11 where a setback 10 is formed so as to leave an intermediate empty zone.

As shown in FIG. 2B, passage over the collar C is performed by pressing the bush 1 inside the skirt 2 axially onto the neck of the receptacle R. This force has the effect of locally deforming the element 11, and more precisely of causing this element to move radially outwards into the empty zone that it occupies at least in part by coming flush with the inside face of the skirt 2.

However, the dimensions of the empty zone 10 and in particular the width e of the setback are predetermined as a function of the expected amplitude of the displacement so as to avoid deforming the skirt 2 in any way. Contact between the bush 1 and the inside wall of the skirt 2 is acceptable providing this contact is not suitable for deforming said skirt and does not modify its consequent external appearance. The displacement of the element 11 is equivalent to pivoting about a hinge formed by the discontinuity in the side wall of the bush that is defined by local narrowing.

In FIG. 2C, the fastener element 11 has passed beneath the collar C and it is locked thereto by its top face 11*a* being retained against the bottom face of said collar.

The intermediate empty zone is again open at its bottom where it can optionally be closed by the shoulder E of the receptacle R.

FIGS. 3A and 3B show a first embodiment of the bush 1. In this embodiment, the bush 1 has four fastener elements 11 that are diametrically opposite in pairs on perpendicular axes.

The setback 10 forms the intermediate empty zone between the skirt 2 and the bush 1 in the bottom portion of the bush. In this case, the setback corresponds to the outer wall of the bush 1 being offset inwards without any significant change to the thickness of the side wall. The height of the setback 10 is not less than the height of the collar C above the shoulder E of the receptacle (see FIG. 2C).

In a variant embodiment (not shown), the setback may also correspond to a reduction in the wall thickness of the bush.

In an embodiment, the setback is 0.60 mm deep for a skirt that is 0.30 mm thick, and for a bush whose minimum thickness is 0.60 mm and whose maximum thickness is 1.30 mm at the fastener elements.

In this case, the fastener elements 11 are constituted by catches carried by the inside wall of the bush 1 and topped by respective abutment and wedging faces 11*a* of profile matching the bottom face of the collar C.

The side faces 11*b* and 11*c* of the Fastener elements 11 in this case project from the cylindrical inside wall of the bush 1 and they lie in vertical planes. The setbacks 10 are centered on the elements 11 and extend over a width 1 that is greater than or equal to the width of said catches, being defined laterally by straight edges 10*b* and 10*c*. The setbacks 10 are defined towards the top by respective sloping flanks 10*a* that slope at an angle $\alpha$ of about 45° relative to a diametral plane so as to facilitate outward pivoting of the bottom portion of the bush.

FIGS. 4A and 4B show a second embodiment of the bush 1 having three fastener elements 11 disposed at 120° intervals.

In this embodiment, the fastener elements 11 are constituted by sloping flanks backing onto the inside cylindrical wall of the bush 1, and defining abutment and retaining top faces 11*a* for engaging beneath the collar C of the receptacle.

In cross-section in a diametral plane, these elements are substantially identical to the Fastener elements of FIGS. 3A and 3B, but unlike those Fastener elements, they do not have any projecting side face.

In this case, the setbacks 10 are formed by flats centered on the flanks 11.

In the embodiment of FIGS. 5A and 5B, the bush has six fastener elements 11 and six setbacks 10 that are substantially identical to those shown in FIGS. 4A and 4B and are located at 60° intervals around the perimeter of the bush 1.

However, since there are more of them, the junctions between the setbacks 10 and the cylindrical outer wall of the bush 1 can be provided without discontinuity.

FIG. 6 is a section view of the assembly device of the invention shown in full together with an inner bush 1 and an outer skirt 2 for packaging. In this case, the skirt 2 has a top rim 21 which completely masks the bush 1 and which defines the outline of the opening 20 in which the dispenser head T or pushbutton of the pump P is received.

In addition to the fastener elements 11, the bush 1 has elements 12 for supporting the pump P.

In this case, the support elements 12 are constituted by a central sleeve 12*a* having snap-fastener members 12*b* co-operating with complementary members carried by the body K of the pump P.

The assembly is sealed, for example, by means of fitted gaskets (not shown) or by a flange 13 secured to the inside wall of the bush 1 bearing directly on the rim of the receptacle.

What is claimed is:

1. A device for assembling and packaging a pump and a receptacle said device comprising a fixing bush having elastically deformable fastener elements axially extending therefrom for fastening beneath a collar of a neck of a receptacle, and a packaging skirt generally having malleable properties and extending along an entire outside wall of said bush, wherein, before assembling and packaging said pump and said receptacle, said device includes setbacks defining respective intermediate empty zones between the outside wall of the bush and said skirt, said setbacks being dimensioned and configured to permit said fastener elements to be displaced elastically radially outwardly during assembly a predetermined distance without remanant deformation of said skirt and said bush, said skirt radially and uniformly clamping against the surface of the outside wall of the bush over an entire height thereof above said zones defined by said setbacks, said skirt clamping said bush without remanent deformation thereof.

2. The device according to claim 1, wherein said setback corresponds to a distance the wall of the bush at the location of the fastener elements is offset radially inwards during installation on a receptacle.

3. The device according to claim 1, wherein said setback is defined by a reduction in the thickness of the wall of the bush opposite said fastener elements.

4. The device according to claim 1, wherein said fastener elements comprise catches carried by the inside wall of the bush and which are configured and dimensioned to snap-fasten beneath the collar of a neck of a receptacle.

5. The device according to claim 1, wherein said catches are topped by respective abutment and wedging faces of a profile that matches the collar of the neck.

6. The device according to claim 1, wherein said setbacks are formed over a height that is not less than the height of the neck of a receptacle intended to receive the device.

7. The device according to claim 1, wherein said bush carries elements for supporting a pump.

8. The device according to claim 1, wherein said bush carries sealing elements for sealing the assembly.

9. A method for assembling a device and a receptacle having a retaining collar, said device being connected to a pump and having a fixing bush that is provided on its inside wall with elastically deformable fastener elements and is surrounded by a skirt that is malleable, said skirt radially and uniformly clamping against the outside wall of the bush over an entire height thereof above zones defined by said setbacks without remanent deformation thereof, the method comprising the steps of:

guiding said retaining collar into contact with said fastener elements while the fastener elements are in a resting non-deformed position;

providing a predetermined empty zone between said skirt and said fixing bush opposite each fastener element when the fastener element is non-deformed;

engaging said retaining collar with said fastener elements so that said fastener elements are deformed elastically and extend radially outward so as to be in a flexed position, said fastener elements extending within said predetermined empty zone without causing remanent deformation of said skirt when in their flexed positions; and locking said bush on said retaining collar with said fastener elements by permitting said fastener elements to elastically return to said resting position and clamp against said retaining collar.

* * * * *